US005911374A

United States Patent [19]

Biehn

[11] Patent Number: 5,911,374

[45] Date of Patent: Jun. 15, 1999

[54] BLADE SHOE FOR A SHEAR SHREDDING APPARATUS

[75] Inventor: Charles S. Biehn, Centerville, Ohio

[73] Assignee: CB Manufacturing & Sales Co., Inc., West Carrolton, Ohio

[21] Appl. No.: 08/976,211

[22] Filed: Nov. 21, 1997

[51] Int. Cl.[6] ..... B02C 18/16

[52] U.S. Cl. ..... 241/236; 241/294

[58] Field of Search ..... 83/839, 840; 241/294, 241/236, 295, 195, 197, 235, DIG. 31

[56] References Cited

U.S. PATENT DOCUMENTS

| | | | |
|---|---|---|---|
| 962,822 | 6/1910 | Edison | 241/294 |
| 2,136,099 | 11/1938 | Buxbaum . | |
| 2,781,176 | 2/1957 | Clark | 241/294 |
| 3,931,935 | 1/1976 | Holman . | |
| 4,374,573 | 2/1983 | Rouse et al. . | |
| 4,560,112 | 12/1985 | Rouse et al. . | |
| 4,607,800 | 8/1986 | Barclay . | |
| 4,627,582 | 12/1986 | Goldhammer . | |
| 4,840,316 | 6/1989 | Barclay . | |
| 4,901,929 | 2/1990 | Barclay . | |
| 5,285,707 | 2/1994 | Lodovico et al. . | |
| 5,292,078 | 3/1994 | Lodovico et al. . | |
| 5,580,010 | 12/1996 | Barclay et al. . | |

FOREIGN PATENT DOCUMENTS

| | | | |
|---|---|---|---|
| 452542 | 10/1949 | Italy | 241/294 |
| 1766507 | 10/1992 | U.S.S.R. | 241/294 |

*Primary Examiner*—Mark Rosenbaum
*Attorney, Agent, or Firm*—Thompson Hine & Flory LLP

[57] ABSTRACT

A blade shoe for use with a shear shredder comprises a block of hardened metallic material having a top surface, a bottom surface, a pair of opposing side surfaces, a front surface and a rear surface, where the top surface and opposing side surfaces meet at sharp angles, and where the top surface includes rows of saw-tooth shaped teeth projecting therefrom. Preferably the rows of saw-tooth shaped teeth extend laterally across the top surface and intersect with the pair of opposing side surfaces, so as to create a corresponding pair of substantially serrated edges at the intersections of the top surface and the opposing side surfaces. Accordingly, the saw-tooth shaped teeth substantially increase the lineal length of the opposing pair of cutting edges, affording substantially longer life for the blade shoe. Another benefit that the saw-tooth shaped teeth provide is that they substantially reduce sliding action of the scrap material that is being sheared, and act to grip and pull the scrap material into the shear zone.

10 Claims, 4 Drawing Sheets

BLADE SHOE FOR A SHEAR SHREDDING APPARATUS

BACKGROUND

The present invention relates to a shear shredder apparatus and, more particularly, to a removable blade shoe for use with a shear shredder apparatus.

Shear shredders are well known and are commonly used to reduce the size of material so that the overall volume of the material is reduced for storage or transportation, or so that particle size of the material is reduced to promote burning or combustion of the material in an incinerator or kiln. The most common application for shear shredders is in the field of waste disposal, where such shear shredders are particularly effective in reducing such items as rubber vehicle tires to chip sizes which promote the burning of the tire material.

A typical shear shredding system includes a support frame having an open top and bottom, and houses a pair of counter rotating shredder blade assemblies. Each shredder blade assembly includes a central shaft and a plurality of individual cutter disks mounted thereon. The cutter disks are spaced apart from one another on the shaft and the pair of counter rotating shredder blade assemblies are positioned with respect to each other so that the cutter disks intermesh with one another. The counter rotation of the inter-meshed cutter disks produce a shearing action within the shearing zone where the two sets of cutter disks intermesh with one another. The waste and scrap materials are introduced into this shearing zone from the open top of the support frame where they are shredded and dropped through the open bottom of the support frame.

As is known to those of ordinary skill, the cutter disks require sharp circumferential edges for efficient operation of the shear shredder. Because prolonged use of the shredders will dull the edges of the cutter disks, it is known to removably mount blade shoes to the outer periphery of the cutter disks so that when the blade shoes become dull, they can be easily replaced. Blade shoes are typically constructed of hardened metallic material, and include bolt-receiving holes bored therethrough to facilitate removable mounting to the outer periphery of the cutter disks. Such blade shoes are typically block-shaped, having flat top, bottom, and side surfaces, which meet at sharp angles. Examples of shear shredders incorporating such removable blade shoes can be found in U.S. Pat. Nos. 3,931,935 to Holman and 4,560,112 to Rouse et al.

One known problem with such shear shredder devices is that the blade shoes must be continuously replaced so that the shredding disks remain sharp enough for efficient operation. Another known problem with such shear shredding machines is that it is often difficult for the cutter disks to pull certain types of scrap material into the shear zone, such as the steel belts of most tires, because such materials tend to slip with respect to the blade shoes. Accordingly, there is a need for an improved blade shoe which simultaneously increases the life of the blade shoe while facilitating a better grip on the scrap materials so as to pull such scrap materials into the shear zone.

SUMMARY

The present invention provides a blade shoe for use with a shear shredding apparatus which remains sharp substantially longer than conventional blade shoes and which also assists in the gripping and pulling of the scrap material into the shear zone created by the counter rotating cutter disks.

The improved blade shoe of the present invention comprises a block of hardened metallic material having a top surface, a bottom surface, a pair of opposing side surfaces, a front surface and a rear surface, where the top surface and opposing side surfaces meet at sharp angles, and where the top surface includes rows of saw-tooth shaped teeth projecting therefrom. Preferably the rows of saw-tooth shaped teeth extend laterally across the top surface and intersect with the pair of opposing side surfaces, so as to create a corresponding pair of substantially serrated edges at the intersections of the top surface and the opposing side surfaces. Accordingly, the saw-tooth shaped teeth substantially increase the lineal length of the opposing pair of cutting edges, affording substantially longer life for the blade shoe. Another benefit that the saw-tooth shaped teeth provide is that they substantially reduce sliding action of the scrap material that is being sheared, and act to grip and pull the scrap material into the shear zone.

Accordingly, it is an object of the present invention to provide a blade shoe for a shear shredding apparatus that has longer life, and it is a further object of the present invention to provide a blade shoe for a shear shredding apparatus that assists in the gripping and pulling of the scrap material into the shear zone. These and other objects and advantages of the present invention will be apparent from the following description, the accompanying drawings and the appended claims.

DETAILED DESCRIPTION

Figure 1:
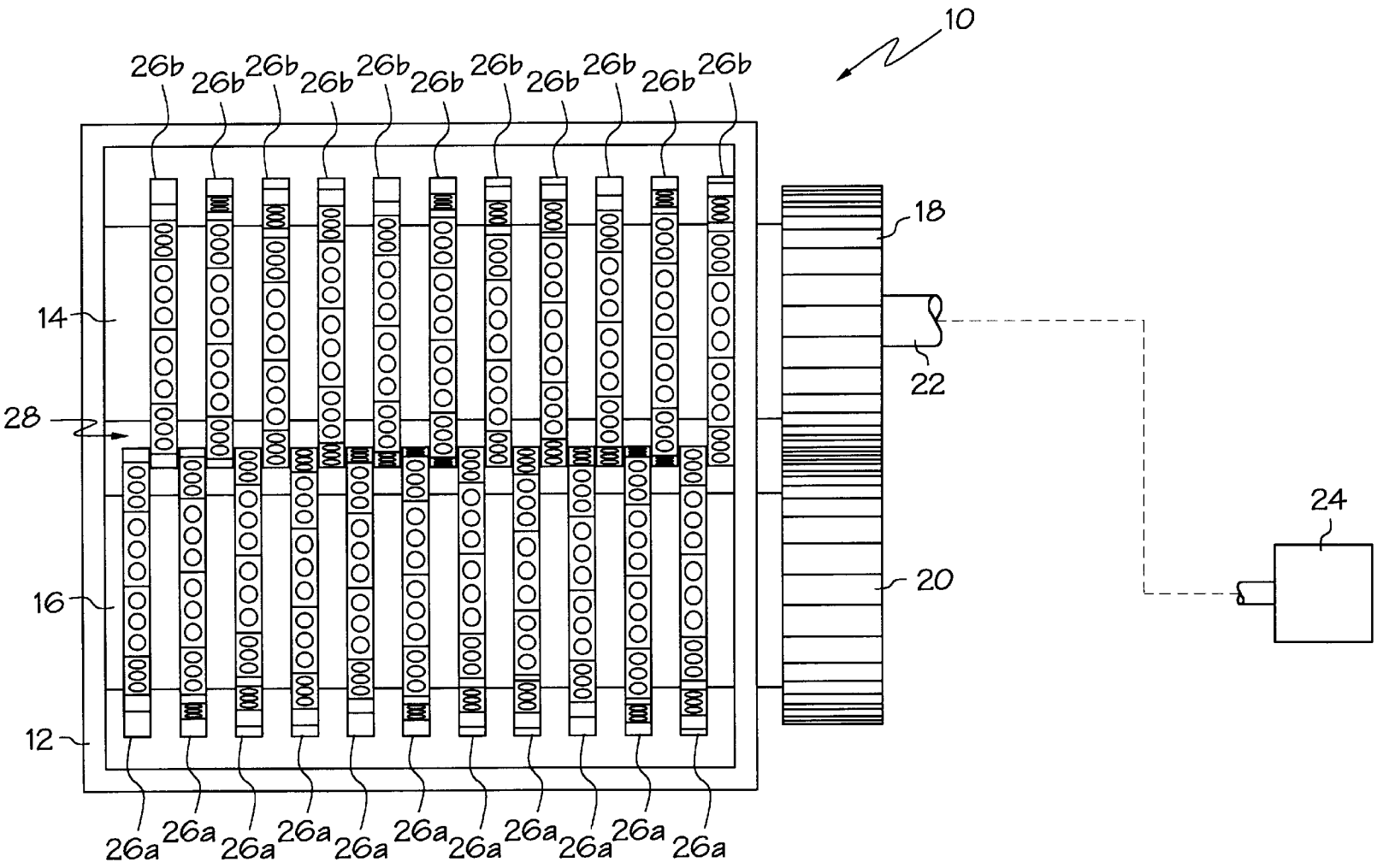
FIG. 1 is a schematic, top plan view of a shear shredding apparatus incorporating the blade shoes of the present invention.

As shown in FIG. 1, shear shredding apparatus 10 includes a frame 12 and a pair of cutter rolls 14 and 16, which are respectively driven by a pair of gears 18 and 20. Gear 18 is rotatably driven by a drive shaft 22, which in turn is driven by motor 24. It will be apparent to those of ordinary skill in the art that suitable gear boxes and other drive mechanisms may be incorporated into the drive system between the motor 24 and the shaft 22. Rotation of the gear 18 in a first direction causes counter-rotation of gear 20 in the opposition direction, which in turn causes counter rotation of the two cutter rolls 14 and 16. Such counter rotation is shown in FIG. 2 by arrows R.

Each of the cutter rolls 14 and 16 include a plurality of axially spaced and evenly distributed cutter disks 26*a* and

26*b* mounted thereon so as to intermesh with one another during the counter rotation of the cutter rolls 14 and 16. Such intermeshing relationship between the cutting disks creates a shear zone 28 within the shredding apparatus where scrap material, such as tires, will be pulled between the counter rotating cutter disks and will then be shredded by the scissor-like engagement between the counter rotating cutter disks in the shear zone.

Figure 2:
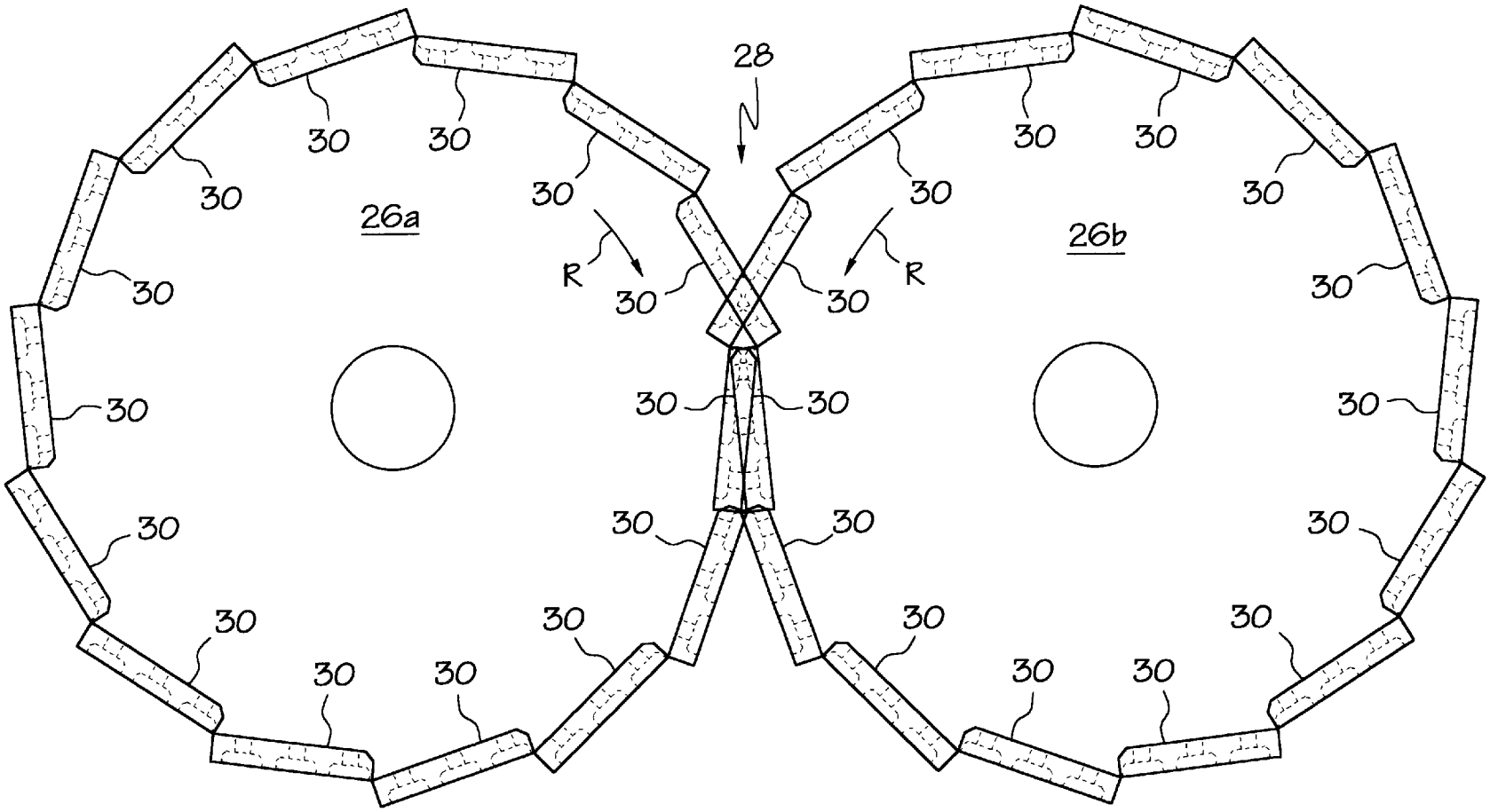
FIG. 2 is a side elevational view depicting counter rotating cutting disks of the shear shredder apparatus, where the cutting disks have the blade shoes of the present invention mounted thereon.
Figure 3:
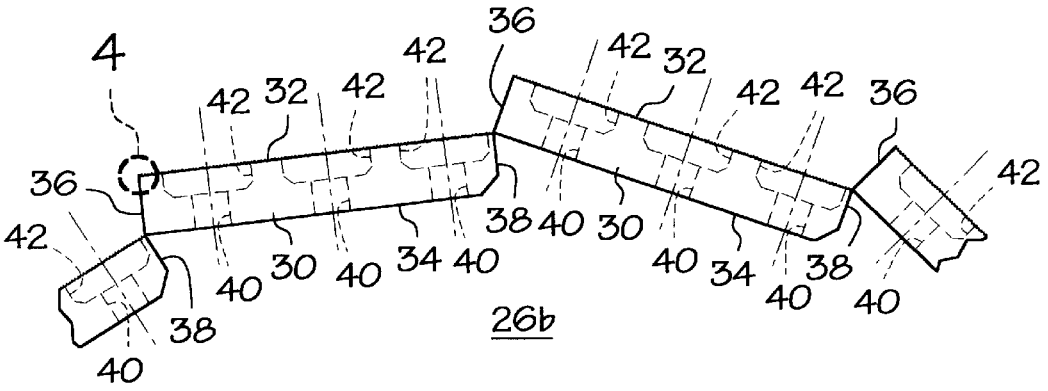
FIG. 3 is a magnified view of FIG. 2, showing the blade shoes of the present invention mounted to a cutting disk of a shear shredding apparatus.

As shown in FIG. 2, the cutting disks 26*a* and 26*b* include a plurality of blade shoes 30 removably mounted to their outer peripheries, substantially tangential to the corresponding outer periphery of the cutting disks. As shown in FIG. 3, each blade shoe 30 includes a top surface 32, a bottom surface 34, a front surface 36 and a back surface 38. Preferably, each blade shoe is positioned on the outer periphery of its associated cutter disks such that its bottom surface 34 meets or touches the top surface of the blade shoe immediately forward thereto. As is further shown in FIGS. 3 and 5, each of the blade shoes 30 include plurality of bolt receiving holes 40 bored therethrough from the top surface to the bottom surface so as to facilitate removable mounting to the outer periphery of the cutting disk with bolts. The shoes also include a corresponding plurality of cylindrical cut-outs 42 extending into the top surface 32 and communicating with the bolt receiving holes 40 so as to provide a space for the bolt heads to seat when the blade shoe is mounted to the outer periphery of the cutting disks, such that the bolt head does not extend above the top surface 32 of the blade shoe in operation. The cylindrical cut-out 42 may also provide additional space for receiving the necessary tooling to tighten and/or loosen the bolts.

Figure 4:
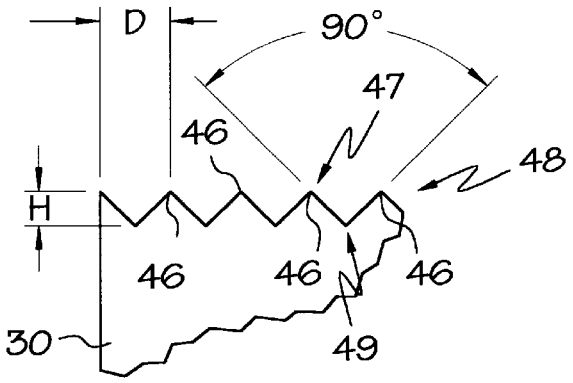
FIG. 4 is a magnified, elevational view of the saw-tooth shaped projections of the blade shoes of FIG. 3.
Figure 6:
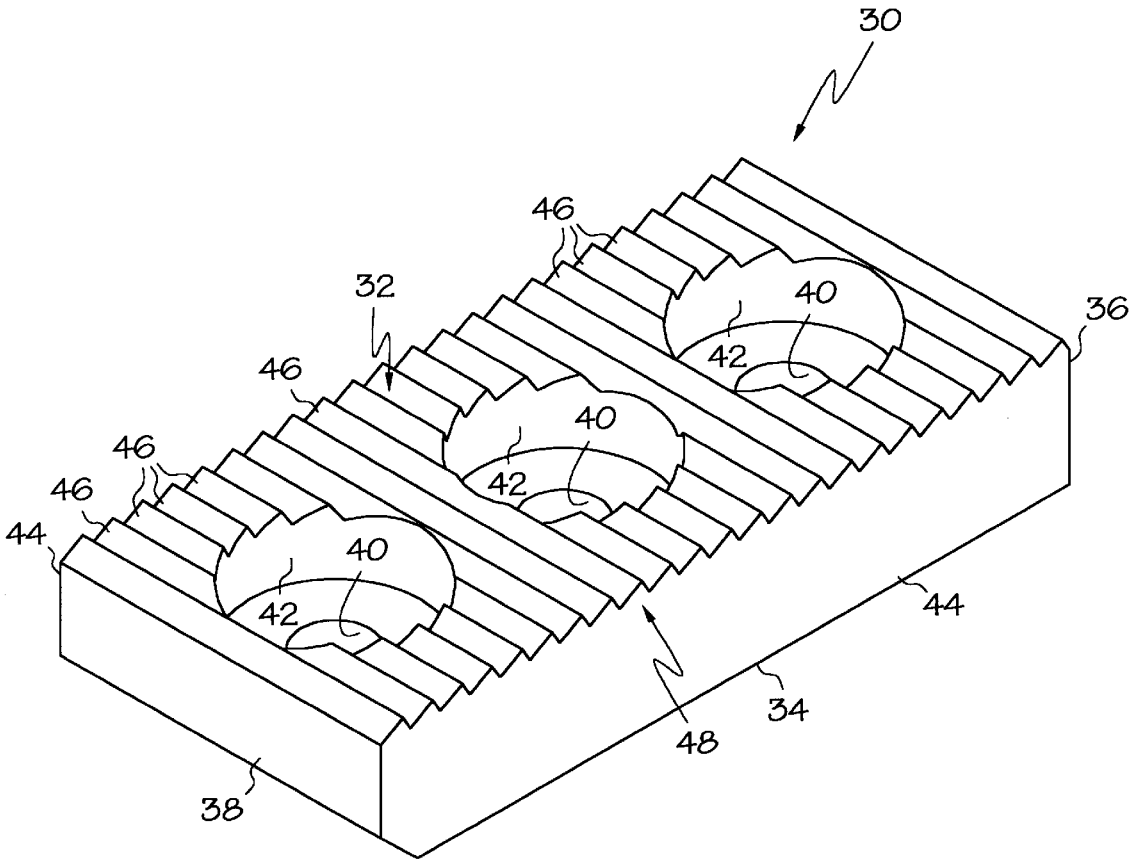
FIG. 6 is a perspective view of a blade shoe of the present invention.

As is best shown in FIGS. 4 and 6, the blade shoes 30 include a pair of opposing side surfaces 44 and a plurality of rows of saw-tooth shaped teeth 46 projecting from the top surface 32 and extending laterally across the top surface from one opposing side surface 44 to the next. Such saw-tooth shaped teeth intersect with each of the opposing side surfaces 44 so as to provide a substantially serrated edge 48 at the intersection of the top surface 32 and each of the opposing side surfaces 44. Accordingly, the saw-tooth shaped teeth provide a cutting edge 48 that is substantially longer (at least approximately 40% longer) in lineal length than the distance between the front surface 36 and the back surface 38. It follows therefore, that the increased lineal length of cutting edge will correspondingly increase the life of the blade shoe.

As shown in FIG. 4, in one embodiment, saw-tooth shaped teeth abut one another and include sloped surfaces that meet at 90° angled apexes 47 and V-shaped troughs 49. As is also shown in FIG. 4, the preferred height H of the saw-tooth shaped teeth range from approximately 0.02 inches to approximately 0.10 inches, and the preferred distance D between the apexes ranges from approximately 0.04 inches to approximately 0.25 inches.

Figure 5:
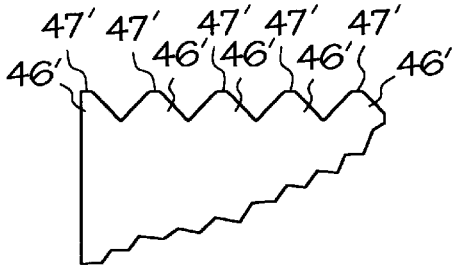
FIG. 5 is a magnified, elevational view of saw-tooth shaped projections of an alternate embodiment of the present invention.

As shown in FIG. 5, it is within the scope of the invention that the saw-tooth shape teeth 46' have substantially flattened tips 47".

As shown in FIG. 6, the saw-tooth shaped teeth 46 preferably extend laterally across the top surface 32 of the blade shoes parallel to each other and to the front and rear surfaces 36, 38 of the blade shoe. Further, the saw-tooth shaped teeth 46 preferably cover the entire top surface 32 of the blade shoe. However, it is within the scope of the invention that only a portion of the top surface of the blade shoe be covered by such saw-tooth shaped projections. It is also within the scope of the present invention that the saw-tooth shaped teeth extend across the top surface of the blade shoe in other patterns such as zig-zag or angled patterns.

Figure 7:
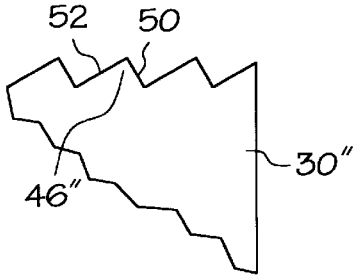
FIG. 7 is a magnified, elevational view of the saw-tooth shaped projections of another alternate embodiment of the present invention.

As shown in FIG. 7, it is within the scope of the invention that a blade shoe 30" includes saw-tooth shaped teeth 46" that have a leading edge sloped surface 50 which is shorter than the trailing edge sloped surface 52.

While the forms of the apparatus herein described constitute the preferred embodiments of the invention, it is to be understood that other forms of the apparatus may be employed without departing from the scope of the invention as defined in the following claims.

What is claimed is:

1. A shredding apparatus comprising:

a pair of counter-rotating rows of cutter discs, the counter-rotating rows of cutter discs rotating on axes that are substantially horizontal and spaced from each other, the rows of cutter discs intermeshing with each other to create a shearing engagement, each of the cutter discs including a plurality of blade shoes substantially tangentially mounted about an outer periphery thereof;

each blade shoe including a block of hardened metallic material having a top surface, a bottom surface, a pair of opposing side surfaces, a front surface and a rear surface;

wherein at least two bolt receiving bores extend through each blade shoe, from the top surface to the bottom surface, to facilitate removable mounting to an associated cutter disc;

wherein the top surface and opposing side surfaces of each blade shoe meet at sharp angles;

wherein a portion of the top surface of each blade shoe includes rows of saw-tooth shaped teeth projecting therefrom, the rows of saw-tooth shaped teeth extending substantially parallel to one another and intersect with both of the opposing side surfaces so as to create a pair of serrated edged where each of the opposing side surfaces intersect with the top surface;

such that each row of the saw-tooth shaped teeth includes a pair of upward sloping surfaces meeting at a tip and having a height of approximately 0.02 inches to approximately 0.10 inches; and wherein adjacent rows of the saw-tooth shaped teeth meet at 90° angled v-shaped troughs.

2. An apparatus for shredding scrap and waste material, comprising:

a pair of counter-rotating rows of cutter discs, the counter-rotating rows of cutter discs rotating on axes that are positioned substantially on a horizontal plane and radially set apart from one another;

the counter-rotating rows of cutter discs intermeshing with each other so as to create a shearing engagement;

each of the cutter discs including a plurality of blade shoes substantially tangentially mounted to an outer periphery of the cutter disc;

the blade shoes including a top surface, a bottom surface, a pair of opposing side surfaces, a front surface and a rear surface;

the top surface and opposing side surfaces meeting at sharp angles; and the top surface including rows of saw-tooth shaped teeth projecting therefrom.

3. The apparatus of claim 2, wherein the rows of saw-tooth shaped teeth extend laterally across the top surface and intersect with at least one of the opposing side surfaces, so as to provide a substantially serrated edge at an intersection of the top surface and the one opposing side surface.

4. The apparatus of claim 3, wherein the rows of saw-tooth shaped teeth extend laterally across the top surface so as to intersect with both of the opposing side surfaces.

5. The apparatus of claim 4, wherein the rows of saw-tooth shaped teeth cover substantially the entire top surface.

6. The apparatus of claim 5, wherein:

each row of the saw-tooth shaped teeth includes a pair of upward sloping surfaces meeting at a 90° angled point; and adjacent rows of the saw-tooth shaped teeth meet at 90° angled v-shaped troughs.

7. The apparatus of claim 6, wherein the saw-tooth shaped teeth abut one another and have a height of approximately 0.02 inches to approximately 0.10 inches.

8. The apparatus of claim 5, wherein:

each row of saw-tooth shaped teeth includes a pair of upward sloping surfaces meeting at a substantially flattened tip; and adjacent rows of the saw-tooth shaped teeth meet at 90° angled v-shaped troughs.

9. The apparatus of claim 5, wherein the rows of saw-tooth shaped teeth are substantially straight and parallel.

10. The apparatus of claim 2, wherein each blade shoe includes a bolt-receiving hole bored therethrough, facilitating removable mounting of the blade shoe to its associated cutter disc.

* * * * *